US005664969A

United States Patent [19]

Peterson et al.

[11] Patent Number: 5,664,969

[45] Date of Patent: Sep. 9, 1997

[54] ELECTRICAL CONNECTOR WITH IMPROVED TERMINAL POSITIONING MEANS

[75] Inventors: Bruce A. Peterson, Schaumburg; Richard A. Faje, Westmont; Frank L. Geoghegan, Hinsdale; Paul A. Rattin, Western Springs; Joseph R. Weltz, Batavia, all of Ill.

[73] Assignee: Molex Incorporated, Lisle, Ill.

[21] Appl. No.: 518,952

[22] Filed: Aug. 24, 1995

[51] Int. Cl.[6] ..... H01R 13/432

[52] U.S. Cl. ..... 439/746; 439/752.5

[58] Field of Search ..... 439/733.1, 744, 439/746, 747, 748, 749, 751, 752

[56] References Cited

U.S. PATENT DOCUMENTS

| | | | |
|---|---|---|---|
| 4,416,504 | 11/1983 | Sochor | 339/252 |
| 4,472,017 | 9/1984 | Sian | 339/217 |
| 4,557,543 | 12/1985 | McCleerey et al. | 439/744 |
| 5,354,218 | 10/1994 | Fry et al. | 439/595 |
| 5,362,260 | 11/1994 | Peloza | 439/746 |
| 5,385,491 | 1/1995 | Fry | 439/595 |

*Primary Examiner*—Neil Abrams
*Assistant Examiner*—T. C. Patel
*Attorney, Agent, or Firm*—Stephen Z. Weiss

[57] ABSTRACT

An electrical connector is adapted for connecting a conductor of an electrical wire to a terminal of a mating connector. A dielectric housing has at least one elongated terminal-receiving cavity defining a longitudinal axis. A terminal is received in the cavity and has a mating portion adapted to mate with the terminal of the mating connector, a conductor-terminating portion, and an intermediate portion joining the mating and conductor-terminating portions. The intermediate portion includes a base and a pair of elongated resilient side walls extending from the base. Each side wall has an upper free end portion. A pair of elongated slots are provided within a wall of the cavity receiving the upper free end portions of the side walls of the terminal to prevent movement of the terminal laterally or angularly of the longitudinal axis.

8 Claims, 3 Drawing Sheets

ELECTRICAL CONNECTOR WITH IMPROVED TERMINAL POSITIONING MEANS

FIELD OF THE INVENTION

This invention generally relates to the art of electrical connectors and, particularly, to a positioning and stabilizing means or system for preventing relative movement of terminals in cavities of a connector housing.

BACKGROUND OF THE INVENTION

A wide variety of mating electrical connectors employ pairs of interengaging terminals for interconnecting a plurality of circuits or wires through the mated connectors. The pairs of terminals may be pin and socket terminals which often are called male and female terminals, respectively.

The terminals are mounted in a plurality of terminal-receiving passageways or cavities in a dielectric housing of the electrical connector. The terminals generally are elongated and are inserted into the cavity along the longitudinal axes of the terminals. Some form of latch means normally are provided to hold the terminals in the cavities against withdrawal therefrom.

One of the ever-continuing problems with electrical connectors of the character described above is maintaining the terminals in proper positions within the connector housing. Instability of the terminals results in terminal movement within the housing, particularly transversely or angularly of their longitudinal axes. The transverse or angular movement of a terminal can cause terminal-to-terminal misalignment between mating connectors which could damage one or both of the mating terminals causing partial or even incomplete electrical connection. It readily can be understood that a pin or male terminal must be properly positioned, stabilized or centered in order to properly mate with a socket or female terminal, and this positioning or centering is critical with the increasing miniaturization of electrical connectors.

The present invention is directed to solving the above stability problems with terminals in electrical connectors by providing a simple but effective positioning means or system between the terminals and the connector housing.

SUMMARY OF THE INVENTION

An object, therefore, of the invention is to provide a new and improved terminal positioning means in an electrical connector.

In the exemplary embodiment of the invention, the connector is illustrated for connecting a conductor of an electrical wire to a terminal of a mating connector. The electrical connector includes a dielectric housing having at least one elongated terminal-receiving cavity defining a longitudinal axis. A terminal is received in the cavity, and the terminal has a mating portion adapted to mate with the terminal of the mating connector, a conductor-receiving portion, and an intermediate portion joining the mating and conductor-terminating portions. The intermediate portion includes a base and a pair of elongated resilient side walls extending from the base. Each side wall has an upper free end portion.

Generally, the invention contemplates the provision of an elongated slot within a wall of the terminal-receiving cavity for receiving the upper free end portion of at least one of the side walls of the terminal to prevent movement of the terminal laterally or angularly of its longitudinal axis. In particular, a pair of the elongated slots are provided for receiving the upper free end portions of the pair of elongated resilient side walls of the terminal. The slots are laterally spaced apart, and the intermediate portion of the terminal is generally U-shaped as defined by the base and the pair of side walls.

The invention also contemplates that the upper face end portion of each side wall include a bent portion offset laterally of the remainder of the side wall to provide a compliant fit within the respective elongated slot. The terminal is stamped and formed of sheet metal material, and the bent portion is sized and configured to provide the compliant fit in the slot.

Lastly, a latch portion of the terminal is formed out of each side wall between the respective bent portion thereof and the base of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
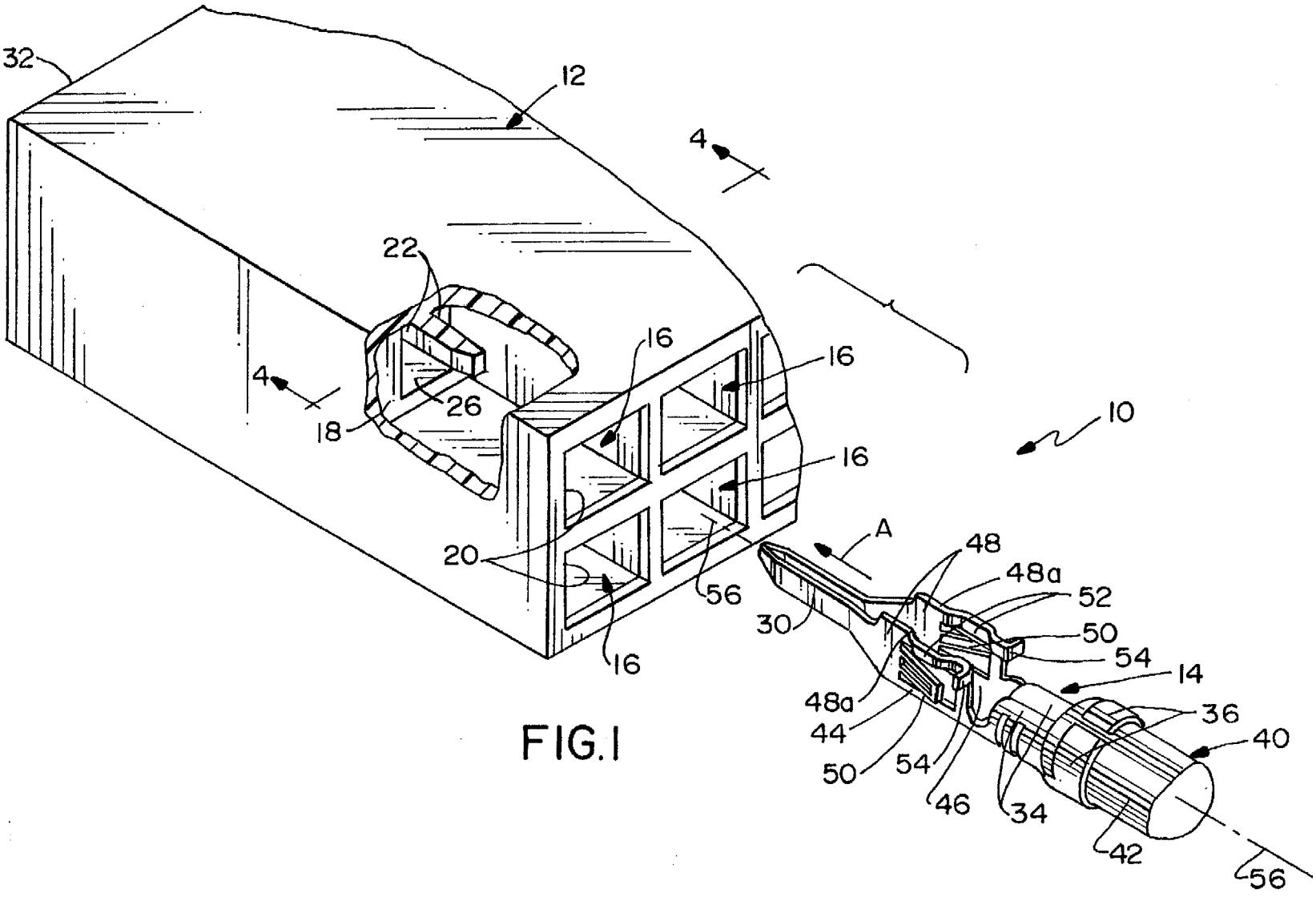
FIG. 1 is a perspective view, partially cut away, to show the interior of a connector housing having a plurality of terminal-receiving cavities, along with one of the terminals, and incorporating the concepts of the invention.
Figure 3:
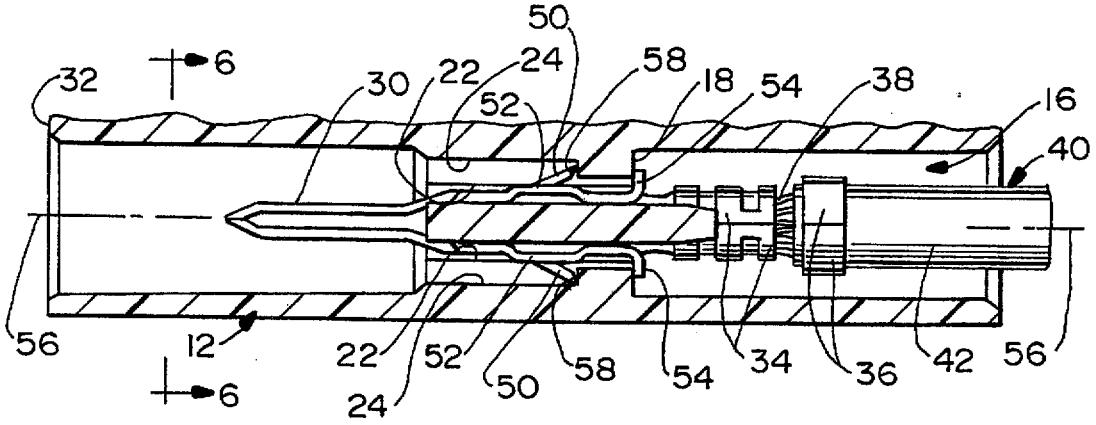
FIG. 3 is a longitudinal horizontal section through one of the terminal-receiving cavities with a terminal disposed therein.
Figure 2:
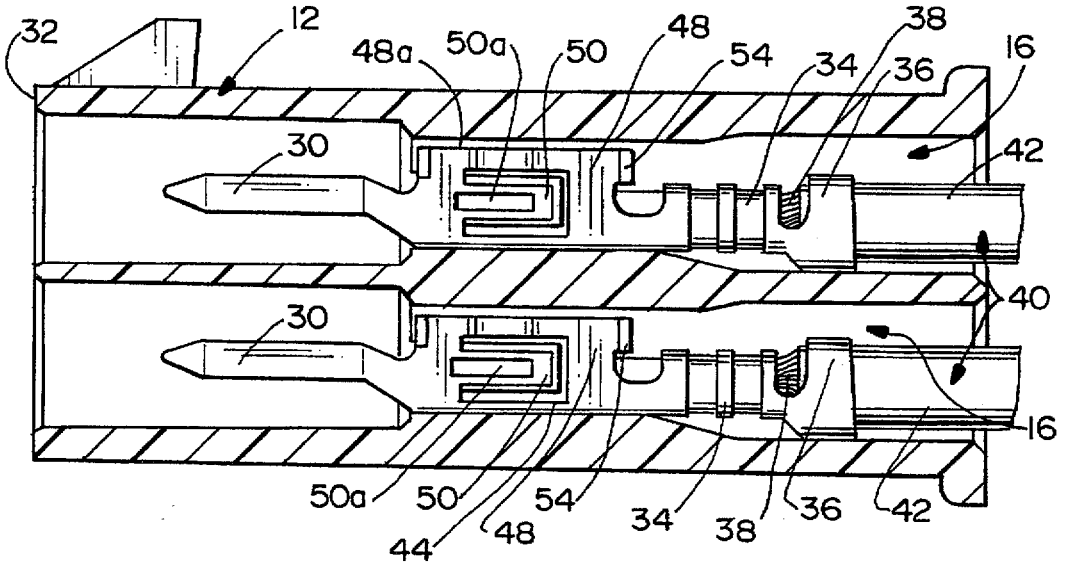
FIG. 2 is a longitudinal vertical section through two of the terminal-receiving cavities with terminals disposed therein.

Referring to the drawings in greater detail, FIGS. 1–3 show an electrical connector, generally designated 10, having a multi-cavity connector housing, generally designated 12, and incorporating the concepts of the invention. The housing is adapted for receiving a plurality of electrical terminals, generally designated 14, individually insertable into a respective one of a plurality of terminal-receiving cavities, generally designated 16, in housing 12. The housing is fabricated of dielectric material, such as being unitarily molded of plastic. The terminals are unitarily fabricated of stamped and formed conductive sheet metal material.

Figure 4:
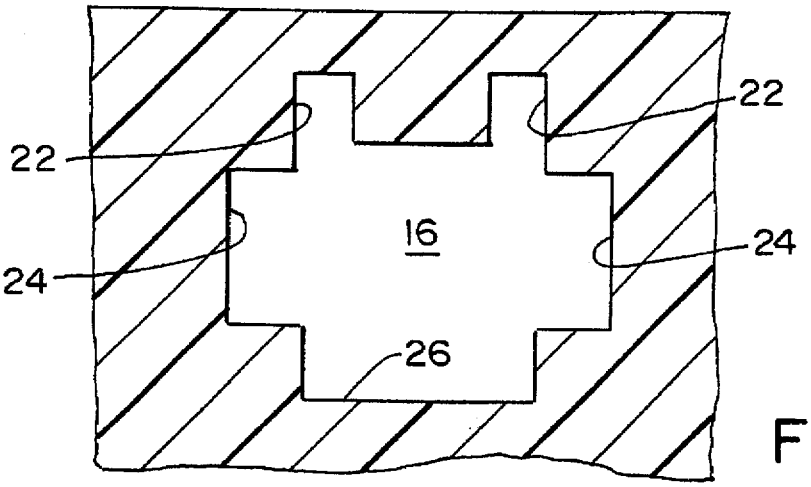
FIG. 4 is a fragmented vertical cross section through one of the terminal-receiving cavities in FIG. 1 with the terminal removed.

FIG. 1 is broken away to show that each terminal-receiving cavity has an interior transverse abutment face 18 spaced inwardly of the respective mouth 20 of each cavity. Each terminal 14 is inserted into its respective cavity 16 through the respective mouth 20 in the direction of arrow "A". FIG. 4 shows that each terminal-receiving cavity 16 is formed with a pair of transversely spaced slots 22 which also can be seen in FIG. 1. These slots run longitudinally of the cavity.

Figure 5:
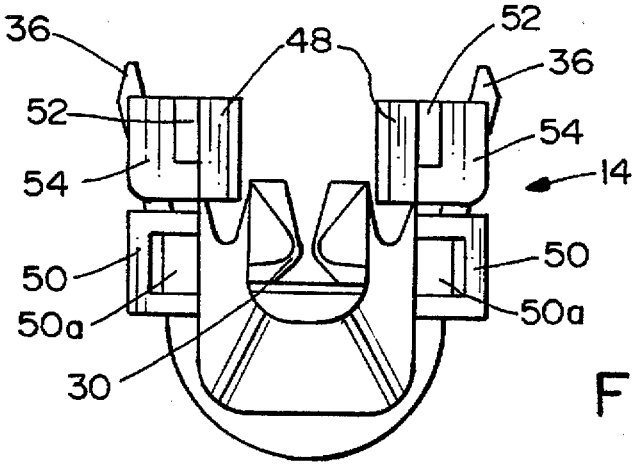
FIG. 5 is an end elevational view of one of the terminals, looking toward the mating end of the terminal.

Referring to FIG. 5 in conjunction with FIGS. 1–3, each terminal 14 includes a mating portion 30 adapted to mate with the terminal of a mating connector (not shown) mateable with a forward mating end 32 of connector housing 12. In the illustrated embodiment, mating portion 30 is formed as a terminal pin for insertion into a terminal socket of the mating connector. Each terminal 14 also has a conductor-terminating portion which is provided by two pairs of crimp arms 34 and 36. The pair of crimp arms 34 are adapted for clamping onto the conductor(s) 38 (FIGS. 2 and 3) of an electrical wire, generally designated 40. The pair of crimp arms 36 are adapted for clamping onto the outer insulation 42 of the electrical wire.

Each terminal 14 also includes an intermediate portion 44 joining mating portion 30 and conductor-terminating portion 34. The intermediate portion is generally U-shaped and includes a base wall 46 and a pair of upstanding side walls 48 extending from the base. Each side wall includes an upper free end portion 48*a*. A spring latch arm 50 is stamped out of each side wall 48 so as to be cantilevered angularly outwardly of the terminal. The latch arms are joined, as at 50*a*, to provide stiffness to the arms. A bent portion 52 is offset laterally outwardly of each side wall 48. Lastly, a pair of stop arms 54 are bent generally perpendicularly outwardly of the terminal behind outwardly bent portions 52. This overall configuration of each terminal 14 defines a longitudinal axis 56 coincident with a longitudinal axis of a respective one of the terminal-receiving cavities 16, with spring latch arms 50, outwardly bent portion 52 and stop arms 54 all extending or projecting transversely outwardly from side walls 48 laterally of axis 56.

Figure 6:
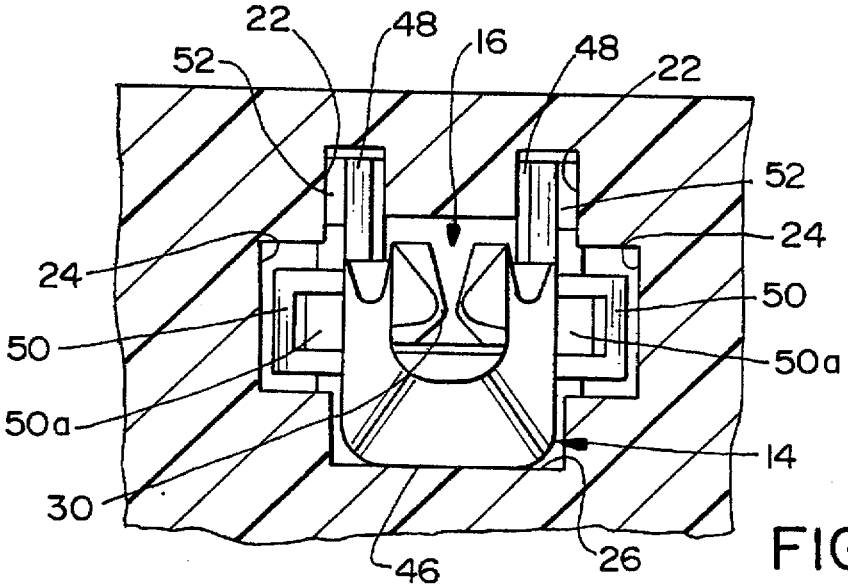
FIG. 6 is a cross section view of FIG. 3 similar to that of FIG. 4, with the terminal of FIG. 5 positioned in the cavity.

FIG. 6 shows one of the terminals 14 inserted into its respective terminal-receiving cavity 16. Base wall 46 of the intermediate portion of the terminal seats on bottom wall 26 within housing 12 as described above in relation to FIG. 1. When the terminal is fully inserted into its cavity, outwardly cantilevered spring latch arms 50 snap into elongated side slots 24 behind a pair of latch shoulders 58 of the housing within the terminal-receiving cavity as shown clearly in FIG. 3. In this fully inserted position, stop arms 54 abut against transverse abutment face 18 within the cavity, as described above in relation to FIG. 1. Therefore, in the fully inserted position of the terminal, the terminal is locked against forward or rearward movement by spring latch arms 50 and stop arms 54 as shown clearly in FIG. 3.

In order to prevent movement of the terminals laterally or angularly of their longitudinal axes relative to connector housing 12, the upper free end portions of side walls 58 move into longitudinal slots 22 at the top of each cavity 16. FIG. 6 shows the side walls having been moved into slots 22. Outwardly bent portions 52 of the side walls also can be seen in FIG. 6 within slots 22. In essence, side walls 48 bear against the inside walls of the slots, while outwardly bent portions 52 bear against the outside walls of the slots, thereby providing a compliant fit within the slots in a longitudinal direction of the terminals. Therefore, the positioning of side walls 48, along with their bent portions 52, in slots 22 is effective to prevent laterally movement of the terminals relative to the connector housing as well as angular movement of the terminals relative to the housing in a direction oblique to the longitudinal axes of the terminals and the terminal-receiving cavities.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for connecting a conductor of an electrical wire to a terminal of a mating connector, the electrical connector including a dielectric housing having at least one elongated terminal-receiving cavity defining a longitudinal axis, a terminal received in the cavity and having a mating portion adapted to mate with the terminal of the mating connector, a conductor-terminating portion, and an intermediate portion joining the mating and conductor-terminating portions, the intermediate portion including a base and a pair of elongated resilient side walls extending from the base, each side wall having an upper free end portion, wherein the improvement in the connector is the terminal positioning and stabilizing means comprising:

a pair of elongated slots within a wall of the cavity, each slot having opposed inner walls and being adapted to slidingly receive the free end portion of a respective one of the side walls of the terminal where both opposed surfaces of each terminal sidewall contact a respective inner wall of a respective slot to prevent movement of the terminal laterally or angularly of the longitudinal axis.

2. An electrical connector as set forth in claim 1, wherein said slots are laterally spaced apart, and the intermediate portion of the terminal is generally U-shaped as defined by said base and said pair of side walls.

3. An electrical connector as set forth in claim 2 wherein said free end portion of each side wall 2 includes a bent portion offsetting the opposed surfaces laterally from the remainder of the side wall to provide a compliant fit within each said elongated slot.

4. An electrical connector as set forth in claim 3, wherein said terminal is stamped and formed of sheet metal material and said bent portion is sized and configured to provide the compliant fit in the slot.

5. An electrical connector for connecting a conductor of an electrical wire to a terminal of a mating connector, the electrical connector including a dielectric housing having at least one elongated terminal-receiving cavity defining a longitudinal axis, a terminal received in the cavity and having a mating portion adapted to mate with the terminal of the mating connector, a conductor-terminating portion, and an intermediate portion joining the mating and conductor-terminating portions, the intermediate portion being generally U-shaped and including a base wall and pair of elongated resilient side walls extending upwardly from the base wall, each side wall having a upper free end portion, wherein the improvement in the connector is the terminal positioning and stabilizing means comprising:

a pair of laterally spaced, elongated slots each slot having opposed inner walls within an upper wall of the terminal-receiving cavity, each slot adapted to slidingly receive an upper free end portion of a respective one of the side walls of the terminal where both opposed surfaces of each side wall contact a respective inner wall of a respective slot to prevent movement of the terminal laterally or angularly of said longitudinal axis, each upper free end portion of each side wall including a bent portion laterally offsetting the opposed surfaces from the remainder of the respective side walls to provide a compliant fit within the respective elongated slot.

6. An electrical connector for connecting a conductor of an electrical wire to a terminal of a mating connector, the electrical connector including a dielectric housing having at least one elongated terminal-receiving cavity defining a longitudinal axis, a terminal received in the cavity and having a mating portion adapted to mate with the terminal of the mating connector, a conductor-terminating portion, and an intermediate portion joining the mating and conductor-terminating portions, the intermediate portion including a base and a pair of elongated resilient side walls extending from the base, each side wall having an upper free end portion, wherein the improvement in the connector is the terminal positioning and stabilizing means comprising:

an elongated slot within a wall of the cavity for slidingly receiving the free end portion of one of the side walls of the terminal having a bent portion offset laterally from the remainder of the side wall to provide a compliant fit within said elongated slot to prevent movement of the terminal laterally or angularly of the longitudinal axis and including a latch portion of the terminal formed out of said one side wall between said bent portion and the base of the terminal.

7. An electrical connector for connecting a conductor of an electrical wire to a terminal of a mating connector, the electrical connector including a dielectric housing having at least one elongated terminal-receiving cavity defining a longitudinal axis, a terminal received in the cavity and having a mating portion adapted to mate with the terminal of the mating connector, a conductor-terminating portion, and an intermediate portion joining the mating and conductor-terminating portions, the intermediate portion being generally U-shaped and including a base wall and pair of elongated resilient side walls extending upwardly from the base wall, each side wall having a upper free end portion, wherein the improvement in the connector is the terminal positioning and stabilizing means comprising:

a pair of laterally spaced, elongated slots within an upper wall of the terminal-receiving cavity for slidingly receiving the upper end portions of the side walls of the terminal to prevent movement of the terminal laterally or angularly of said longitudinal axis, each upper free end portion of each side wall including a bent portion offset laterally of the remainder of the respective side wall to provide a compliant fit within the respective elongated slot and further including a latch portion formed out of each side wall between said bent portion and the base wall of the terminal.

8. An electrical connector as set forth in claim 7, wherein said terminal is stamped and formed of sheet metal material and each bent portion is sized and configured to provide the compliant fit within its respective slot.

* * * * *